US011585110B2

(12) United States Patent
Milani

(10) Patent No.: US 11,585,110 B2
(45) Date of Patent: Feb. 21, 2023

(54) MODULAR POOL

(71) Applicant: A.P.I. ITALIA S.R.L., Masera' di Padova (IT)

(72) Inventor: Alessandro Milani, Montegrotto Terme (IT)

(73) Assignee: A.P.I. ITALIA S.R.L., Masera' di Padova (IT)

( * ) Notice: Subject to any disclaimer, the term of this patent is extended or adjusted under 35 U.S.C. 154(b) by 0 days.

(21) Appl. No.: 17/481,316

(22) Filed: Sep. 22, 2021

(65) Prior Publication Data

US 2022/0090400 A1 Mar. 24, 2022

(30) Foreign Application Priority Data

Sep. 23, 2020 (IT) ..... 102020000022462

(51) Int. Cl.
*E04H 4/00* (2006.01)

(52) U.S. Cl.
CPC ..... *E04H 4/0043* (2013.01); *E04H 4/0031* (2013.01)

(58) Field of Classification Search
CPC ..... E04H 4/0034; E04H 4/0043
USPC ..... 4/488
See application file for complete search history.

(56) References Cited

U.S. PATENT DOCUMENTS

2007/0266651 A1* 11/2007 Harig ..... E02D 27/00 52/169.6

FOREIGN PATENT DOCUMENTS

| | | |
|---|---|---|
| FR | 2962467 A1 | 1/2012 |
| JP | H08291636 | 11/1996 |
| JP | H0926870 A | 1/1997 |
| JP | H09268790 | 10/1997 |

* cited by examiner

*Primary Examiner* — Christine J Skubinna

(57) ABSTRACT

Modular pool comprising a support structure placed around a containment basin for the water and comprises a plurality of metal plates, joined together, which comprise a base for resting on the ground, an upright at least partially above ground, and lateral edges provided with a reinforcement flange. The pool also comprises fixing elements fixed to the base of the metal plates and anchored to the ground, a waterproofing layer placed to coat a bottom and a lateral surface of the containment basin, and a surface finish layer placed to cover the waterproofing layer.

14 Claims, 4 Drawing Sheets

MODULAR POOL

FIELD OF APPLICATION

The present invention regards a modular pool.

The present modular pool is intended to be employed in a residential setting for the arrangement of pools and hydromassage tanks of the type to be installed in a garden or on a terrace.

More in detail, the present modular pool is installed to be installed at least partially raised with respect to a ground surface and does not require making foundations or other construction works that are invasive of the surrounding environment.

The invention is therefore inserted in the context of the industrial field of production of pools and of components for pools.

STATE OF THE ART

As is known, there are mainly two types of pools: buried pools, which require the execution of an excavation in order to make a containment basin for the water below the ground surface level, and above-ground pools, provided with perimeter walls which extend upward above the ground surface level, to delimit the basin of the pool. In particular, an example of buried pool of known type is described in the document JP H08291636.

In particular, buried pools have the advantage of being able to be completely personalized by the client who commissions them, both regarding the shapes and the depth of the basin, as well as for the materials employed.

Such buried pools have the drawback of requiring the attainment of considerable construction works, such as for example making foundations for the pool, generally made of reinforced concrete or other heavy materials, which increase the costs thereof and the attainment times. In addition, for excavations greater than 50 cm, particular building concessions are required, which greatly increase the complexity of the pool design and attainment works.

However, the above-ground pools are simpler to install, since they do not require building concessions, nor do they require making excavations or foundations.

Nevertheless, such above-ground pools have the drawback of not being easily personalizable by the client who commissions it, especially with regard to the form and depth of the basin of the pool.

In order to allow a greater personalization of the form of the basin, above-ground pools of modular type are known, which are provided with perimeter walls made with modular elements, which can be joined together in order to make perimeter walls with different perimeter forms.

In particular, the aforesaid modular elements are generally made of concrete or reinforced concrete in order to ensure a suitable strength of the pool with regard to the horizontal thrust of the water on the perimeter walls.

The outdoor modular pools of known type briefly described above have in practice demonstrated that they do not lack drawbacks.

A first drawback is tied to the costs of making the aforesaid modular elements in concrete, which require rather long and costly work operations.

In addition, the aforesaid concrete modular elements are also rather bulky to store in a warehouse, and are also heavy and complicated to be transported in the site of installation of the pool.

A further drawback of the aforesaid modular pools of known type lies in the fact that the concrete modular elements confer an aesthetic appearance to the pool that is not very appreciated in luxury settings, where the use of refined materials is preferred as these give prestige to the pool, and therefore pools are usually externally coated. It is clear however that such coating operations increase the times and costs of installation of the above-ground pools of known type.

Therefore, in settings like hotels and recreation structures, there is presently the great need for modular pools that can be easily and quickly installed, without requiring invasive construction works, and which simultaneously allow being extremely personalizable by the buyer client, as well as being very much appreciated by the clients in the structure where they are installed.

The document JP H0926870 describes a modular pool of known type, whose lateral walls are made by means of multiple vertical metal plates placed one next to the other in a manner such to delimit the perimeter of the pool itself. More in detail, each metal plate is fixed by means of bolting to a cement foundation made along the edge of the pool and is provided, on its external side, with buttresses fixed to the cement foundation in order to allow the metal plate to sustain the lateral thrust of the water.

Also the latter solution of known type does not lack drawbacks, since it requires making a cement foundation around the pool in order to fix the metal plates and requires the arrangement of external buttresses in order to sustain the lateral thrust of the water.

PRESENTATION OF THE INVENTION

In this situation, the problem underlying the present invention is therefore that of overcoming the drawbacks manifested by the modular pools of known type, by providing a modular pool and a process for making said pool which allow installing the pool in a brief time and without making invasive construction works.

A further object of the present invention is to provide a modular pool which allows obtaining pools that are aesthetically appreciable, even in luxury settings.

A further object of the present invention is to provide a modular pool comprising a plurality of modular elements that are light and not very bulky, which allow limiting the storage size, as well as facilitating the movements thereof at the site of installation of the pool.

A further object of the present invention is to provide a modular pool which is simple and inexpensive to make and entirely reliable in operation.

BRIEF DESCRIPTION OF THE DRAWINGS

The technical characteristics of the invention, according to the aforesaid objects, and the advantages thereof will be more evident in the following detailed description, made with reference to the enclosed drawings, which represent a merely exemplifying and non-limiting embodiment of the invention, in which.

DETAILED DESCRIPTION OF A PREFERRED EMBODIMENT

Figure 1:
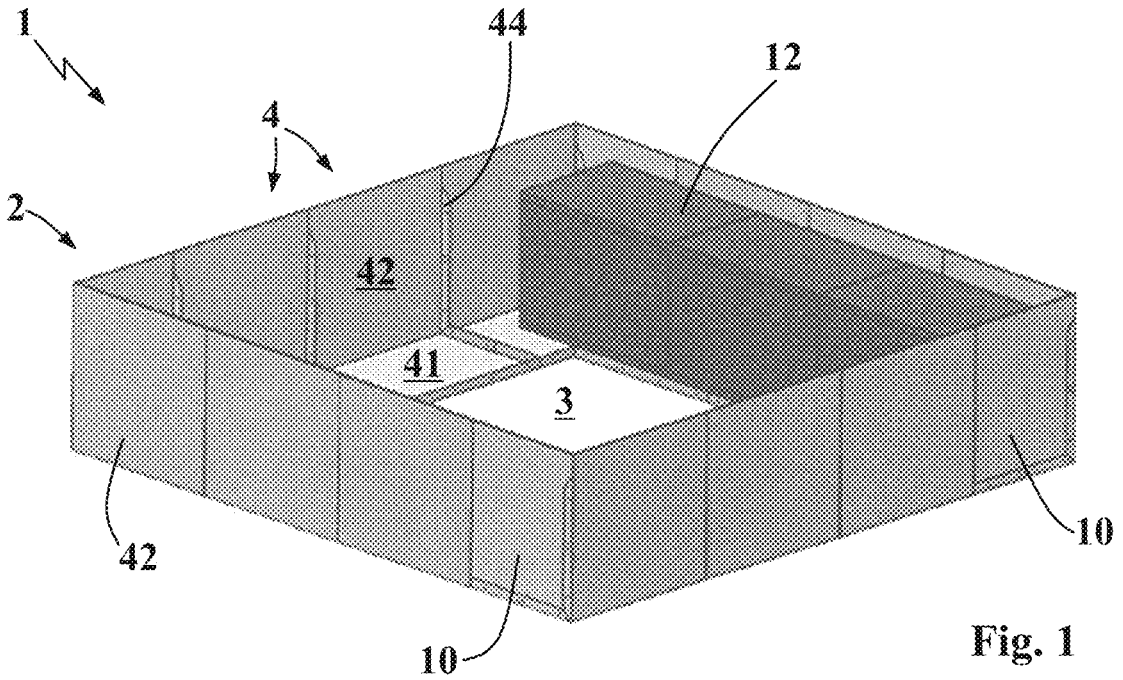
FIG. 1 shows a perspective view of a modular pool, object of the present invention.

With reference to the enclosed drawings, reference number 1 overall indicates a modular pool.

In particular, in the text of the present document, with the term "pool" it is intended any one water basin for recreational, athletic or decorative use, such as for example residential pools, athletic pools, tanks, hydromassage tanks, fountains or other items.

The present pool 1 is advantageously intended to be installed in gardens or on terraces, without having to make construction works that are invasive of the surrounding environment, such as for example foundations made of reinforced concrete or excavations that are over 50 cm deep, which can require particular building concessions. A further advantage of the present pool 1, as is better described hereinbelow, is tied to its weight, which is more limited than conventional modular pools of known type and which allows installing the present pools 1 even without the aforesaid invasive construction works, as well as on terraces or other raised structures.

According to the idea underlying the present invention, the present pool 1 comprises a support structure 2 provided for around a containment basin 3 for the water of the pool 1; such containment basin 3 is delimited by a bottom 31 and by a perimeter surface 32.

The support structure 2 comprises a plurality of metal plates 4 with substantially constant thickness, which are joined together and comprise a base 41 for resting on the ground and an upright 42 at least partially above ground.

In particular, with the expression "for resting on the ground", in the present document reference is made to a generic ground surface, and not necessarily to a terrain/ground comprising topsoil. For example, the ground on which the base 41 of the metal plates 4 is rested can be constituted by the masonry base of a terrace or by a sand or gravel base specially spread on a garden. In this context, in the present document the expression "above-ground" is to be intended as "raised with respect to the ground surface".

According to the invention, each metal plate 4 of the support structure 2 also comprises at least one lateral edge 43 provided with a reinforcement flange 44 and preferably comprises two opposite lateral edges 43 and two reinforcement flanges 44, one for each lateral edge 43, as is better described hereinbelow.

The present pool 1 also comprises fixing elements 5, which are fixed to the base 41 of the metal plates 4 and are intended to be anchored to the ground.

The pool 1 also comprises a waterproofing layer 6, fixed to the support structure 2 to coat the bottom 31 and the perimeter surface 32 of the containment basin 3.

The pool 1 also comprises at least one surface finish layer 7, placed to cover the waterproofing layer 6.

Advantageously, the modular pool 1 thus obtained is easy to attain, since the metal plates 4 are easy to be transported and installed at the site. In addition, the arrangement of the fixing elements 5 advantageously allows retaining in position the metal plates 4 without having to make suitable foundations for the pool 1.

In particular, the above-described metal plates 4 act as a modular element for making the support structure 2, and can be advantageously joined together in order to make support structures 2 with shapes and sizes that are different from each other, which are easily personalizable by the buyer client of the present pool 1.

Preferably, as is illustrated in the enclosed figures, the metal plates 4 are made in a single body, with the base 41 and the upright 42 connected to each other by means of a bend 45 of the metal plate 4 itself. Of course, the alternative embodiment is also possible, in which the base 41 and the upright 42 of the metal plates 4 are attained starting from distinct metal plates, separated from each other, and connected by a support framework, by a welding or other item.

Preferably, moreover, the metal plates 4 are made of steel, and more preferably of corten steel, which confers a pleasant aesthetic effect to the pool 1.

Advantageously, the aforesaid metal plates 4 (made of corten steel or not) can be coated with another material, for example with a layer made of ceramic, wood or still other material. In particular, such coating is preferably attained on the surface of the metal plates 4 intended to be placed in view, and in particular on the surface of the upright 42 directed towards the exterior of the pool 1.

Advantageously, the aforesaid metal plates 4 have a thickness comprised between 0.5 mm and 7 mm and preferably have a thickness of about 2 mm. The metal plates 4 thus attained have a weight comprised between 4.5 and 63 $kg/m^2$, and preferably of about 18 $kg/m^2$, and are more compact and lighter than conventional modular elements made of concrete, currently employed in modular pools of known type. In addition, the aforesaid metal plates 4 are more easily transportable and installable at the site of the pool.

Preferably, the metal plates 4 have semi-box shape, which confers a particular stability on the ground thereto (in particular without having to make cement beds) and a particular mechanical strength (e.g. with regard to the lateral thrust of the water).

Advantageously, the pool 1 made with the aforesaid metal plates 4 and coated at least with the waterproofing layer 6 and with the surface finish layer 7, as is better described hereinbelow, has an overall weight lower than 70 $kg/m^2$, and thus is light and easy to install.

As indicated above, each metal plate 4 comprises preferably two lateral edges 43 that are opposite each other and substantially L-shaped. More in detail, each lateral edge 43 is provided with a first section (substantially horizontal) corresponding to a lateral edge of the base 41 and with a second section (substantially vertical) corresponding to a lateral edge of the upright 42.

Figure 2:
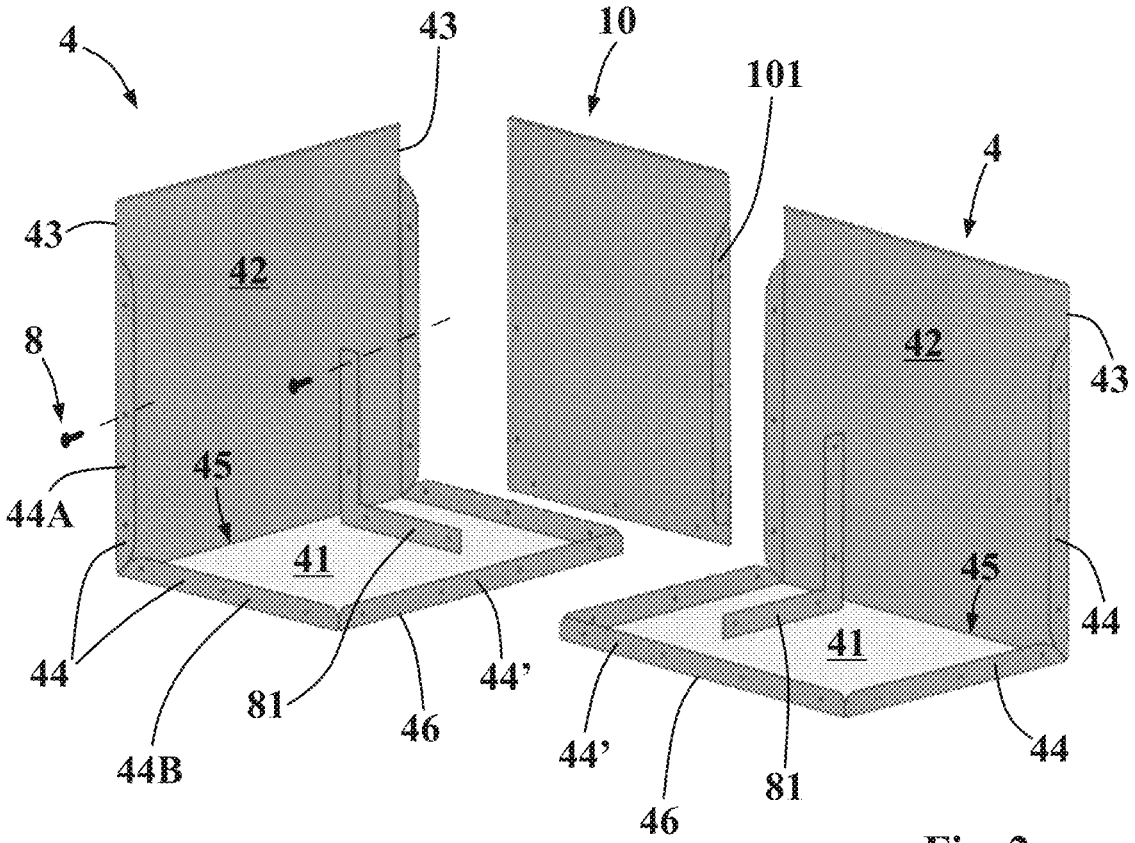
FIG. 2 shows a perspective view in exploded view of several elements of a modular pool, object of the present invention.

Advantageously, moreover, each metal plate 4 comprises at least two reinforcement flanges 44, and in particular comprises four reinforcement flanges 44, two for each lateral edge 43, including one for the first section and one for the second section of each lateral edge 43 of the metal plate 4 (as illustrated in FIG. 2).

Advantageously, the aforesaid reinforcement flanges 44 confer mechanical strength to each metal plate 4, preventing the horizontal thrust of the water contained within the containment basin 3 from being able to deform such metal plates, making them bend towards the exterior of the pool 1.

In particular, the reinforcement flanges 44 of each lateral edge 43 of the metal plate 4 comprise a first reinforcement flange 44A on the first section of the lateral edge 43 (on the corresponding edge of the base 41) and a second reinforcement flange 44B placed on the first section of the lateral edge 43 (on the corresponding edge of the upright 42).

Advantageously, the first reinforcement flange 44A on the first section of the lateral edge 43 is rigidly fixed to the second reinforcement flange 44B on the second section of the lateral edge 43.

For example, the first reinforcement flange 44A is fixed to the second reinforcement flange 44B by means of welding or mechanical means (such as sections, bolts, brackets, etc.).

Advantageously, the rigid connection between the first and second reinforcement flanges 44A, 44B allows conferring, to the metal plate 4, a structure that is particularly strong which allows the upright to sustain the lateral thrust of the water, in particular without requiring external buttresses applied to the upright 42 itself.

Advantageously, the metal plates 4, not requiring external buttresses, have the external side of the upright 42 which is free of additional structures and can be easily finished when the metal plate is made at the production side, without having to add external covering structures during the installation of the pool.

In particular, the aforesaid reinforcement flanges 44 are preferably attained by means of bending of the metal plate 4, or they can be attained separately from the metal plate 4 and connected to the latter by means of welding.

In accordance with the enclosed FIG. 1, the metal plates 4 are preferably placed in succession, side-by-side each other with the reinforcement flanges 44 of two adjacent metal plates 4 fixed to each other by means of junction elements 8.

In particular, the two adjacent metal plates 4 are placed with the respective reinforcement flanges 44 in abutment against each other, and are directed towards the interior of the pool 1 (i.e. towards the containment basin 3), in particular projectingly extending from the internal surface (directed towards the containment basin 3) of the metal plate 4. For such purpose, the reinforcement flanges 44 are advantageously placed at 90° with respect to the base 41 or to the upright 42 from which they are extended, so as to be substantially coplanar with the reinforcement flanges 44 of the adjacent metal plate 4.

Advantageously, the junction elements 8 which fix together the reinforcement flanges 44 of two adjacent metal plates 4 comprise rivets, screws or bolts, inserted to traverse aligned holes of the two reinforcement flanges 44 to be fixed (see for example the enclosed FIG. 2).

Advantageously, the aforesaid junction elements 8 also comprise a plurality of L-shaped sections 81 situated against corresponding reinforcement flanges 44 and retained to the latter by means of the above-described rivets (screws or bolts), to reinforce the junction of two adjacent metal plates 4. In particular, each L-shaped section 81 is fixed to the corresponding first reinforcement flange 44A (along the edge of the base 41) and to the corresponding second reinforcement flange 44B (along the edge of the upright 42), in a manner such to rigidly fix the first reinforcement flange 44A to the second reinforcement flange 44B.

Otherwise, the junction elements 8 can comprise welding lines, attained between the reinforcement flanges 44 of two adjacent metal plates 4.

Figure 7:
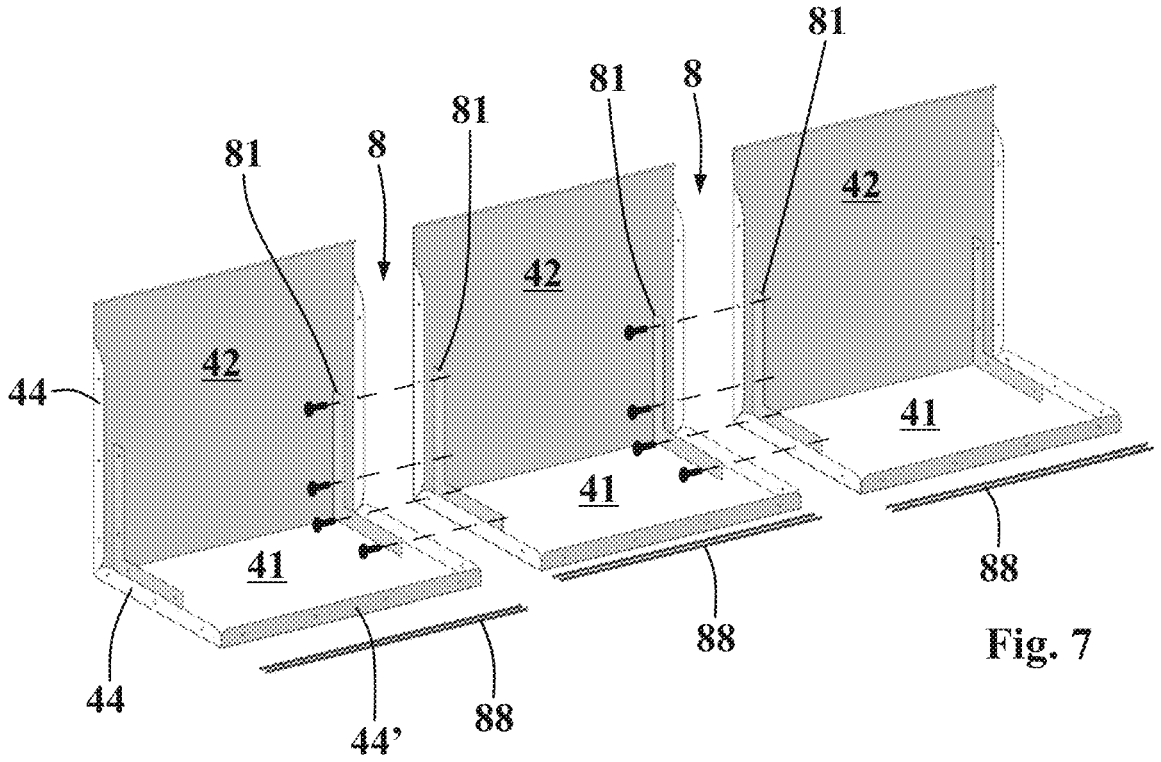
FIG. 7 shows a further perspective view in exploded view of several elements of a perimeter wall of the modular pool, object of the present invention.

In particular, in accordance with the preferred embodiment illustrated in the exploded view of FIG. 7, each reinforcement flange 44 is situated against a corresponding L-shaped section 81, such that the junction between two adjacent metal plates 4 comprises two reinforcement flanges 44 interposed between two L-shaped sections 81 and retained to the latter by means of rivets, screws or bolts or the above-described welding lines.

Figure 8:
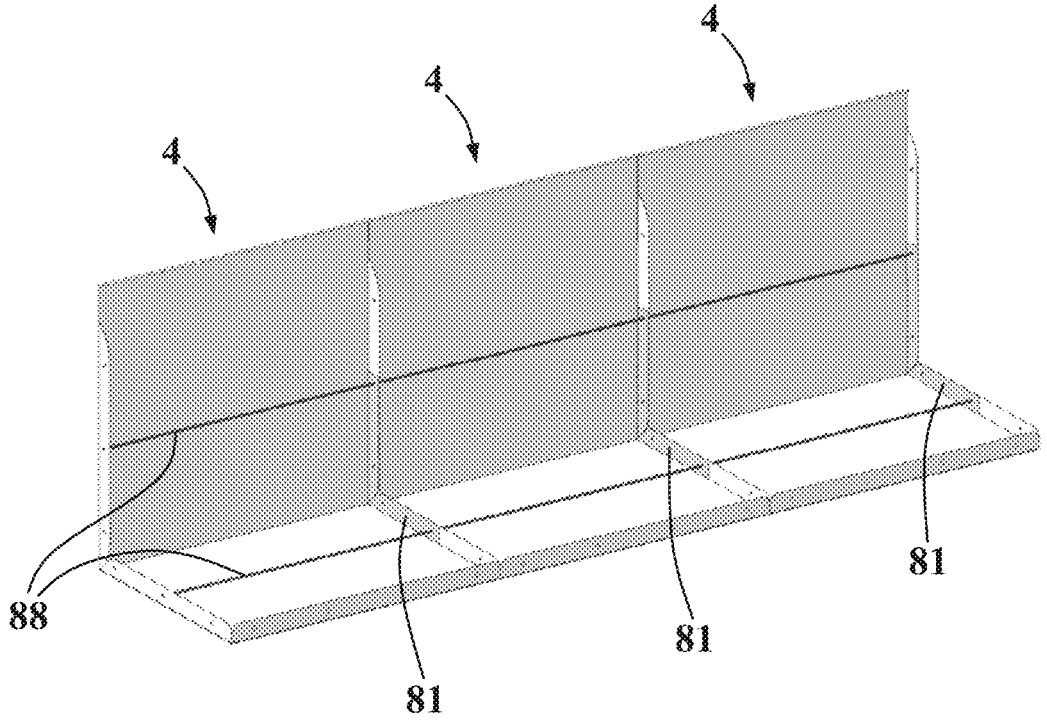
FIG. 8 shows a perspective view of the elements of FIG. 7, connected to each other to make at least one section of a perimeter wall of the present modular pool.

In accordance with a preferred embodiment of the present invention, illustrated in the enclosed FIGS. 7 and 8, the junction elements 8 comprise one or more tie rods 88 placed to connect between at least three consecutive metal plates 4.

In particular, each tie rod 88 is extended between the two reinforcement flanges 44 of the metal plate 4 with which it is associated, and additionally is also extended to traverse the reinforcement flanges 44 of the two metal plates 4 between which the aforesaid metal plate 4 is interposed. More preferably, moreover, each tie rod 88 is extended also beyond the aforesaid reinforcement flanges 44 of the adjacent metal plates 4, and is also placed to traverse the L-shaped section 81 fixed to the latter.

More in detail, each tie rod 88 is preferably placed to traverse a first L-shaped section 81, two adjacent reinforcement flanges 44 and a second L-shaped section 81, then the tie rod 88 is extended for the entire extension of the metal plate 4 with which it is associated up to being placed to traverse a third L-shaped section 81, two adjacent reinforcement flanges 44 and a fourth L-shaped section 81.

Advantageously, additionally, each tie rod 88 is fixed to the aforesaid first and fourth L-shaped sections 81 by means of a pair of nuts, susceptible of acting in opposition against possible elongations of the tie rod 88.

In particular, the aforesaid tie rods 88, fixed as indicated above to three consecutive metal plates 4, are susceptible of retaining the various metal plates 4 aligned and adjacent to each other also in the case of yielding of the ground underlying one or more metal plates 4. Indeed, in the latter event, the metal plates 4 would tend to follow the progression of the ground, each being moved away from the others.

In operation, therefore, the tie rods 88 and the nuts that retain them to the metal plates 4 oppose the aforesaid moving-away, retaining the metal plates 4 always aligned with each other and ensuring a greater stability to the entire pool 1.

Advantageously, as indicated above, the aforesaid tie rods 88 are fixed to the L-shaped sections 81 by means of nuts (not illustrated) placed to connect the end of such tie rods to the L-shaped sections 81. For such purpose, the tie rods 88 are preferably constituted by threaded bars or tubes provided with threaded ends with which the aforesaid nuts are screwed.

In accordance with the enclosed FIG. 8, the tie rods 88 can be fixed to the L-shaped sections 81, all aligned with each other. Otherwise, it is possible to fix the aforesaid tie rods 88, misaligned with each other, with the tie rods 88 of each metal plate 4 placed to traverse different through holes of the reinforcement flanges 44 and of the L-shaped sections 81.

Preferably, the aforesaid tie rods 88 are fixed at least to a base portion of the corresponding L-shaped section 81, i.e. they are fixed to the portion of the L which is situated against the reinforcement flange 44 which is extended from the first section (horizontal) of the lateral edge 43 of the metal plate 4.

Of course it is also possible to fix such tie rods to vertical portions of the L-shaped section 81, as is illustrated in the enclosed FIG. 8.

Preferably, in accordance with the enclosed figures, the metal plates 4 are placed with their bases 41 directed towards the interior of the pool 1 (i.e. towards the interior of the containment basin 3), extended at least on part of the bottom 31 of the containment basin 3, in a manner such that, in particular, only the uprights 42 are visible from outside the pool 1 (as is illustrated in FIG. 1).

Advantageously, additionally, the metal plates 4 can be joined together in order to make pools 1 of various size, also quite extended, and the bases 41 of the metal plates 4 might not cover the entire bottom of the containment basin 3 of the pool 1, but only an internal edge thereof (as is illustrated in FIG. 1).

In accordance with the enclosed FIG. 2, the bases 41 of each metal plate 4 comprise an internal margin 46, directed towards the interior of the pool 1, and preferably provided with a further reinforcement flange 44', substantially vertical.

In particular, the aforesaid further reinforcement flange 44', together with the two lateral reinforcement flanges 44 and with the upright 42, substantially delimits a box-like body of the base 41, which is susceptible of being filled with ballast material (stones or other items), as is better described hereinbelow.

Advantageously, the base 41 of the metal plate 4 has length greater than or equal to a fourth (and preferably to a third) of the height of the upright 42. For example, the base 41 has length comprised between 40 cm and 60 cm and the upright has height comprised between 50 cm and 100 cm.

In particular, the base 41 length-wise extension starting from the upright 42 (and in particular from the bend 45) up to the internal margin 46. The upright 42 is extended vertically height-wise from the base 41 (and in particular from the bend 45) up to an upper edge of the metal plate 4.

The aforesaid proportions between base 41 and upright 42 allow obtaining a load-bearing structure of the metal plate 4, since the base 41 is capable of ensuring the lift of the metal plate 4 due to the vertical thrust of the weight of the water, in particular without having to make a bed of reinforced concrete below the metal plates 4.

Figure 3:
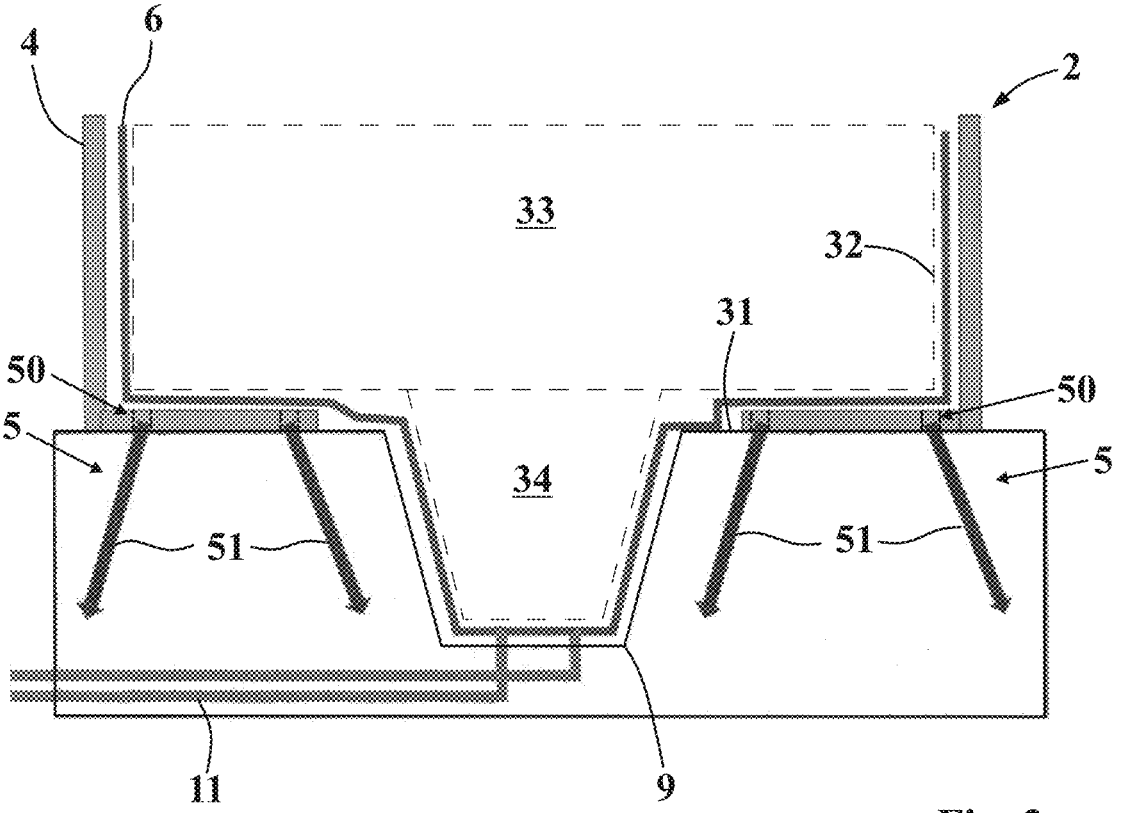
FIGS. 3 and 4 show two schematic views of a section of a modular pool, object of the present invention, made along a vertical section plane, relative to two possible embodiments of the present pool.
Figure 5:
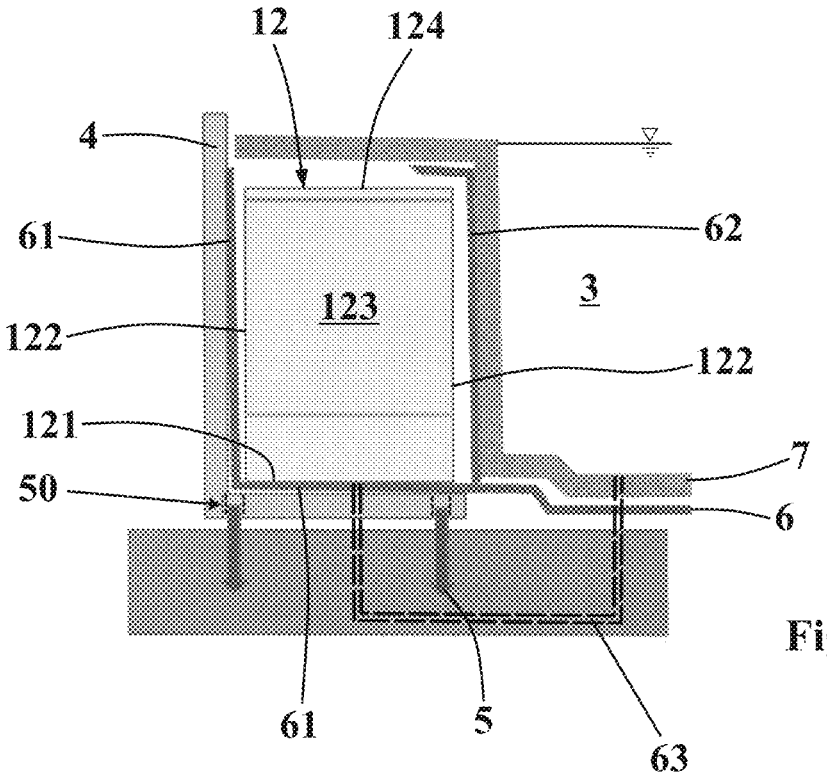
FIGS. 5 and 6 show two schematic views of a section of a modular pool, object of the present invention, made along a vertical section plane, relative to further two possible embodiments of the present pool.

In accordance with a first embodiment, illustrated in the enclosed FIGS. 3 and 5, the bases 41 of the metal plates 4 are provided with through holes 50 (schematically illustrated in FIGS. 3 and 5) and the fixing elements 5 comprise a plurality of stakes 51, placed to traverse the aforesaid through holes 50 and driven into the ground.

In particular, the stakes 51 of the fixing elements 5 are preferably placed tilted, and for example they are all tilted in the same direction so as to not interfere with each other.

Otherwise, in particular, in the event in which the pool 1 is installed on a terrace or on a masonry bed, where it is not possible to drive the stakes 51, the fixing elements 5 comprise a plurality of blocks, these also placed to traverse the through holes 50 of the base 41.

Figure 4:
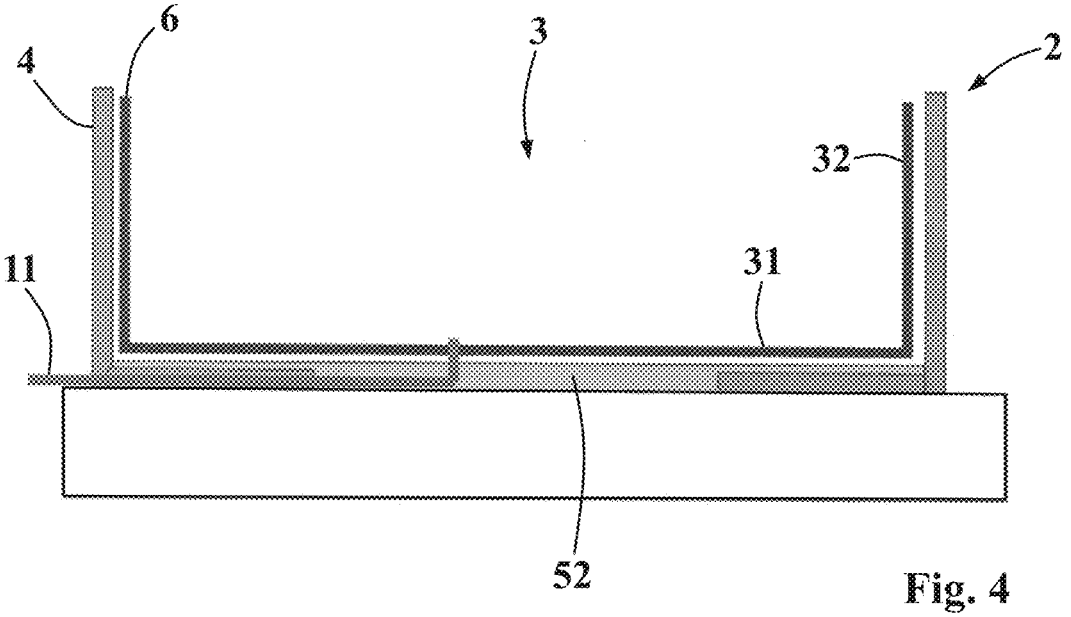

Otherwise, additionally, in accordance with a second embodiment illustrated in FIG. 4, the fixing elements 5 can comprise a cover layer 52, preferably made of a heavy material such as the blast material indicated above or a cement cast.

More in detail, the aforesaid cover layer 52 is extended to cover the bases 41, and preferably the entire bottom 31 of the containment basin 3, and its weight fixes the metal plates 4 to the ground, retaining it in position.

Of course a third embodiment is also possible, "intermediate" between the aforesaid first and second embodiments, in which the fixing elements 5 comprise both the stakes 51 (or the blocks) and the cover layer 52. In the latter case, the cover layer 52 can also be made of a lightened material, such as for example expanded polystyrene (EPS) or expanded clay, which can be easily modeled and advantageously allows shaping the form of the containment basin 3, as is better described hereinbelow.

Advantageously, in addition, the aforesaid lightened materials are optimal thermal insulation elements and allow obtaining an optimal insulation of the pool 1 towards the exterior.

In accordance with the embodiment illustrated in the enclosed FIG. 3, the present pool 1 can be made partially above-ground and partially buried.

More in detail, in such embodiment, the containment basin 3 comprises a portion at least partially above ground 33, perimeter delimited by the perimeter surface 32 and by an internal edge of the bottom 31; such internal edge is extended at the bases 41 of the metal plates 4, in particular starting from the bend 45 towards the pool 1 center.

In addition, in such embodiment of FIG. 3, the containment basin 3 also comprises a buried portion 34 of the bottom 31, such buried portion is extended into the ground starting from the internal edge, delimiting a buried volume.

In particular, the aforesaid buried volume is delimited by a bottom (preferably flat) and by lateral walls, preferably tilted and more preferably provided with a self-bearing tilt, which does not require making foundations made of reinforced concrete.

Advantageously, the aforesaid buried volume is attained by means of an excavation 9 in the ground, and is therefore preferably provided for pools 1 installed in gardens, in which it is possible to make the aforesaid excavation 9.

Advantageously, moreover, the excavation 9 has a depth smaller than 50 cm, so as to not require particular building concessions for the attainment thereof.

The aforesaid embodiment, partially above-ground and partially buried, advantageously allows obtaining containment basins 3 with depth greater than the height of the uprights 42, and hence allow a greater personalization of the present pool 1.

Advantageously, in the aforesaid embodiment it is possible to shape the above-ground and buried portions 33, 34 so as to visibly obtain a single containment basin 3, provided with a depth that gradually increases from the support structure 2 towards the center of the containment basin 3.

Advantageously, moreover, both in the completely above-ground embodiment, and in the partially above-ground embodiment, it is possible to arrange the upright 42 of the metal plates 4 at least partially buried in a pre-excavation made in the ground and arrange the base 41 buried in the aforesaid pre-excavation.

In particular, the aforesaid pre-excavation preferably has a depth smaller than 10 cm and it is adapted to hide from view the resting of the base 41 on the ground, in order to obtain a finished effect that is aesthetically more appreciable by a user of the pool 1.

In accordance with the embodiment of FIG. 1, the pool 1 has substantially rectangular (or square) shape and comprises four perimeter walls connected to each other by four right angles. Of course, other embodiments of the present pool 1 are also possible, provided with a different number of perimeter walls or provided with non-right angles, without departing from the protective scope of the present patent.

Advantageously, the support structure 2 comprises at least one flat element 10 joined to the metal plates 4 at at least one corner of the pool 1 and preferably at each corner of the pool 1.

In particular, at the corners of the present pool 1, two consecutive metal plates 4 are placed in two distinct angular positions, with the flat element 10 interposed between the two uprights 42, to close the corner of the pool 1.

More in detail, in accordance with the enclosed FIG. 2, at one corner of the pool 1 the reinforcement flange 44' of the internal margin 46 of one of the two metal plates 4 is placed in abutment against the reinforcement flange 44 of the lateral edge 43 of the other metal plate 4. In addition, the two metal plates 4 are placed with the respective uprights 42 tilted with respect to each other (e.g. tilted by 90 degrees if the pool 1 has rectangular shape). In this manner, between the uprights 42 of the two metal plates 4, an opening remains defined that is closed by the flat element 10, which thus comes to close the corner of the pool 1, as indicated above.

Advantageously, the aforesaid flat elements 10 are joined to the reinforcement flanges 44 of the two metal plates 4, in particular by means of the junction elements 8. For such purpose, the flat elements 10 are advantageously provided with at least one connection flange 101 (visible in FIG. 2), susceptible of being placed in abutment against a reinforcement flange 44 of a corresponding metal plate 4.

Preferably, the flat elements 10 are also metallic panels substantially with constant thickness, and preferably they are made of the same material as the metal plates 4 and with the same thickness as the latter, so as to attain the support structure 2 that appears substantially uniform.

As indicated above, the present pool 1 comprises at least one waterproofing layer 6 placed to coat the bottom 31 and the perimeter surface 32 of the containment basin 3.

In particular, the aforesaid waterproofing layer 6 is mounted on the support structure 2 to cover an internal face thereof, directed towards the containment basin 3 and is also extended along the bottom 31 of the containment basin 3 to coat the entire containment basin 3 itself in order to prevent the outflow of the water contained at its interior.

Advantageously, the aforesaid waterproofing layer 6 is fixed to an upper margin of the uprights 42 of the metal plates 4, so as to coat the entire perimeter surface 32.

Advantageously, the present pool 1 comprises multiple waterproofing layers 6, e.g. it can comprise a waterproofing layer 6 below the bases 41 of the metal plates 4, not illustrated in the enclosed figures.

Preferably, the waterproofing layer 6 comprises one or more sheets, made of EPDM (Ethylene-Propylene Diene Monomer). PVC or another suitable material, which are welded together in order to cover the entire extension of the containment basin 3.

In accordance with the enclosed FIGS. 3 and 4, the present pool 1 also comprises a hydraulic system 11 comprising a plurality of pipes for introducing and drawing water into/from the containment basin 3.

In a per se known manner, the hydraulic system 11 also comprises one or more water circulation pumps, one or more filters and a plurality of introduction and suction mouths, placed to connect between the aforesaid pipes and the containment basin 3.

Advantageously, the present pool 1 also comprises an electrical system, aimed to power supply the circulation pumps of the hydraulic system, in addition to illuminating the pool 1; this is also known to the man skilled in the art and thus is not better described hereinbelow.

Advantageously, the present pool 1 is of "infinity" type, i.e. it has the containment basin 3 substantially completely filled with water, with the free surface of the water that flows over the top of the support structure 2.

For such purpose, the pool 1 advantageously comprises at least one compensation tank 12 alongside at least two or more metal plates 4 of the support structure 2, and preferably placed along the entire perimeter of the support structure 2, preferably along an internal face of the support structure 2 itself.

In particular, the compensation tank 12 is susceptible of collecting a volume of water overflowed from the containment basin 3 (for example at the entrance of bathers into the pool) and is hydraulically connected to the latter in order to newly introduce the overflowed water volume at its interior.

In particular, in accordance with the embodiment illustrated in the enclosed FIG. 5, the compensation tank 12 is interposed between the support structure 2 and the containment basin 3 so as to collect the volume of water that overflows from the containment basin 3 before such volume of water exits from the pool 1, externally with respect to the support structure 2.

Preferably, moreover, the compensation tank 12 has substantially box-like shape and comprises a bottom wall 121, abutted against the base 41 of the metal plates 4, and a plurality of lateral walls 122, which are extended starting from the bottom wall 121 to delimit a collection volume 123 of such compensation tank 12.

Advantageously, the compensation tank is provided with an open upper face 124, through which the water volume overflowed from the containment basin 3 is susceptible of entering into the collection volume 123 of the compensation tank 12.

In order to hide the compensation tank 12 from view and prevent foreign bodies, such as leaves, insects or other things, from entering into the collection volume 123 through the open face 124, the latter is advantageously covered with a drainage cover, which allows the water that overflows from the containment basin 3 to pass through and retains possible foreign bodies. In particular, the aforesaid drainage cover is preferably made of the same material that constitutes surface finish layer 7, as is better described hereinbelow.

Advantageously, moreover, the compensation tank 12 is separated by the containment basin 3 and is hydraulically connected to the latter by means of a hydraulic duct 63 (schematically represented in FIG. 5). In this manner, it is possible to force the volume of water overflowed from the containment basin 3 to pass through a filter before conveying it once again into the containment basin 3, removing foreign bodies possibly present in the collection volume 123.

In particular, as is illustrated in the enclosed FIG. 5, the waterproofing layer 6 comprises a first section 61, interposed between the support structure 2 and the compensation tank 12, and a second section 62 interposed between the compensation tank 12 itself and the containment basin 3, for the hydraulic separation between the latter.

In this manner, the compensation tank 12 is thus substantially coated with the waterproofing layer 6 and is hydraulically connected to the containment basin 3 only by means of its open upper face 124 (from which it is filled with the overflowed water volume) and by means of the hydraulic duct 63 (from which it is emptied of the overflowed water volume).

Preferably, the aforesaid hydraulic duct 63 for connecting the compensation tank 12 with the containment basin 3 is hydraulically connected to the hydraulic system 11 of the pool 1 and the water contained in the collection volume 123 is advantageously conveyed into the containment basin 3 by means of the circulation pumps of the hydraulic system 11 itself.

In the case of pools 1 of limited size, such as for example hydromassage tanks, it is possible to place the compensation tank 12 only along a brief section of the support structure 2

(for example only along one side of the support structure 2) and made a collection channel 13 along the remaining perimeter of the support structure 2.

In particular, the collection channel 13 has a smaller size than the compensation tank 12 and is thus susceptible of collecting a smaller volume of water overflowed from the containment basin 3. Therefore, the collection channel 13 is preferably always installed together with at least one compensation tank 12.

Figure 6:
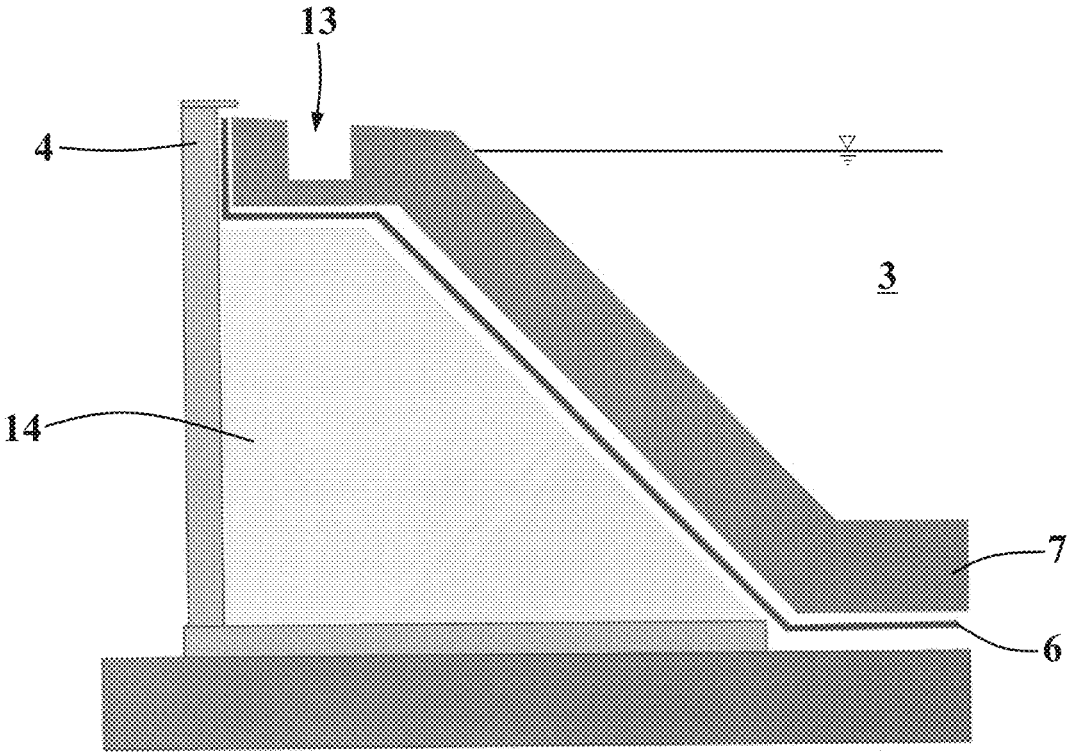

In accordance with the embodiment illustrated in the enclosed FIG. 6, the collection channel 13 is extended along an upper margin of the uprights 42 of the metal plates 4, at a greater height than the containment basin 3, and is hydraulically connected to the latter in order to newly introduce the overflowed water volume at its interior.

Advantageously, the collection channel 13 is provided with perimeter walls made of drainage material (preferably the same material that constitutes the surface finish layer 7), and a waterproofing layer is not present between the collection channel 13 and the containment basin 3. In this manner, the collection channel 13 and the containment basin 3 are hydraulically connected through the same drainage material constituting the perimeter walls of the collection channel 13 itself.

Of course, it is also possible to hydraulically separate the collection channel 13 from the containment basin 3 by means of a waterproofing layer. In this case, the collection channel 13 and the containment basin 3 are hydraulically connected by means of a pipe of the hydraulic system 11.

Preferably, also the collection channel 13 is provided with an upper face covered with a drainage material, so as to hide from view the collection channel 13 itself.

In a further embodiment, not illustrated in the enclosed figures, the aforesaid collection channel 13 can be filled with the drainage material, for example made of the same material constituting the surface finish layer 7, or made of a larger grain size than the latter, or the present collection channel 13 can be substituted by a perimeter edging, entirely made of drainage material and defining a drainage zone of the pool 1.

Of course it is also possible to have an alternative form of the pool 1, not of infinity type, without departing from the protective scope of the present patent. In particular, such non-infinity embodiment of the pool 1 does not comprise the compensation tank 12, nor the collection channel 13 and in their place it comprises a skimmer, well-known to the man skilled in the art and thus not described in detail hereinbelow.

As indicated above, the present pool 1 comprises a surface finish layer 7 placed to cover the waterproofing layer 6.

Preferably, the surface finish layer 7 is made of drainage material, preferably comprising granular bodies (stones or rock) bonded together by a binder, for example a porous resin, possibly admixed with a bactericide agent and/or bacteriostatic agent and/or antibacterial agent.

Advantageously, the aforesaid surface finish layer 7 is made directly at the site of installation of the pool 1 and does not present grout lines or joints that are aesthetically and visibly unpleasant.

Otherwise, the surface finish layer 7 can be made of non-drainage material, for example tiles, stone slabs, wood, metal or still other material.

In accordance with the enclosed FIG. 6, the present pool 1 advantageously comprises one or more shaped bodies 14, interposed between the support structure 2 and the waterproofing layer 6 and adapted to shape the containment basin 3. For example, such shaped bodies 14 can make ramps, steps, seats or another item within the containment basin 3.

Advantageously, the aforesaid shaped bodies 14 are made of EPS, expanded clay or of another material that can be easily shaped into the desired shape.

A process for making the above-described above-ground pool 1 is described hereinafter, and regarding which—for the sake of description simplicity—the same reference nomenclature will be maintained.

According to the idea underlying the present invention the present process provides for a step for arranging a plurality of the aforesaid metal plates 4.

In particular, as indicated above, the metal plates 4 are provided with a substantially constant thickness and comprise a base 41, an upright 42 and at least one lateral edge 43 provided with a reinforcement flange 44.

Preferably, the metal plates 4 are attained in a single body, with the base 41 and the upright 42 joined together by a bend 45. Preferably, moreover, the metal plates 4 are made of steel and more preferably of corten steel.

The present process also provides for a step for mounting a support structure 2 around the containment basin 3 of the pool 1. In the present mounting step, the metal plates 4 are joined together and are placed with the base 41 rested on the ground and the upright 42 at least partially above ground.

Preferably, in the aforesaid mounting step, the metal plates 4 are placed in succession, side-by-side each other with the reinforcement flanges 44 of two adjacent metal plates 4 fixed together by means of the junction elements 8.

In particular, the reinforcement flanges 44 of two adjacent metal plates 4 are placed one in abutment against the other and they are fixed to each other by means of the rivets or the bolts described above. Preferably, moreover, at least one L-shaped section 81 is fixed to at least one reinforcement flange 44, as a further reinforcement of the junction of two adjacent metal plates 4.

Preferably, moreover, in the aforesaid mounting step, at least one tie rod 88 is associated with at least one metal plate 4, and more preferably at least one tie rod 88 is associated with each metal plate 4, with the two ends of the aforesaid tie rod 88 fixed to the reinforcement flanges 44 of the two adjacent metal plates 4 and to the L-shaped sections 81 against the latter, as described above.

Advantageously, in the aforesaid mounting step, a plurality of flat elements 10 are joined to the metal plates 4 at the corners of the pool 1, to close the latter, as is illustrated in the enclosed FIG. 2.

In particular, the flat elements 10 are joined to the metal plates 14 by means of the junction elements 8, arranging the rivets to connect a reinforcement flange 44 with the connection flange 101.

Preferably, before the aforesaid mounting step the present process also provides for a step for arranging the ground for the installation of the pool, in which the ground is levelled and possible stones or elements are removed which could protrude within the containment basin 3.

According to the invention, the present process also provides for a step for fixing the support structure 2 to the ground, in which the fixing elements 5 are fixed to the base 41 of the metal plates 4 and are anchored to the ground.

In particular, in the aforesaid fixing step each metal plate 4 is fixed to the ground by means of the fixing elements 5 so as to retain the pool 1 in position.

Preferably, in such fixing step, the aforesaid plurality of stakes 51 (or blocks) is inserted to traverse through holes 50 suitably made in the base 41 of each metal plate 4 and is driven into the ground.

Otherwise, in the aforesaid fixing step a cover layer 52, preferably made of heavy material (e.g. cement), is placed to cover the base 41 of each metal plate 4, fixing it to the ground.

The present process then provides for a waterproofing step, in which a waterproofing layer 6 is fixed to the support structure 2 to coat the bottom 31 and the perimeter surface 32 of the containment basin 3.

In particular, in such waterproofing step one or more sheets made of waterproofing material waterproofing layer are extended to cover an internal face of the support structure 2 and of the bottom 31 of the containment basin 3, so as to coat the entire containment basin 3 with the waterproofing layer 6.

The present process also provides for a surface finish step, in which the waterproofing layer 6 is covered with a surface finish layer 7, preferably made of a drainage material (in particular granular bodies bonded together by a porous binder) which is preferably made onsite.

Advantageously, the present process also provides for a step of laying a hydraulic system 11 and an electrical system of the pool 1.

In particular, the aforesaid laying steps are preferably executed before the step of waterproofing the pool, so as to place the ducts of the hydraulic system 11 and the wires of the electrical system below the waterproofing layer 6, externally with respect to the containment basin 3.

Advantageously, the present process also provides for a step of shaping of the containment basin 3, preferably before the waterproofing step, during which one or more shaped bodies 14 are placed inside the support structure 2 to shape the containment basin 3, and subsequently covered by the waterproofing layer 6. For example, such shaped bodies 14 can be placed in order to make ramps, steps, seats or still other items within the containment basin 3.

Preferably, before the mounting step, the present method also provides for a step for excavating the ground in order to make a buried portion 34 of the bottom 31 of the containment basin 3, so as to attain the pool 1 partially above-ground and partially buried.

In particular, during the aforesaid excavation step, an excavation 9 in the ground is made, starting from the internal edge of the bottom 31 of the containment basin 3, internally with respect to the internal margins 46 of the bases 41 of the metal plates 4.

Advantageously, before the mounting step, the present method also provides for a step of pre-excavation of the terrain/ground in order to make a pre-excavation in which the base 41 of the metal plates 4 is buried, in particular so as to hide from view the resting of the base 41 on the ground.

In particular, the aforesaid pre-excavation step can be executed together with the excavation step, or it can be executed separately with respect to the latter, for example in the case of containment basins 3 which do not comprise the buried portion 34.

Advantageously, the present process also provides for a step for installing a compensation tank 12 and/or a collection channel 13 of the above-described type, which are installed along two or more metal plates 4 of the support structure 2.

In particular, as indicated above, the compensation tank 12 is preferably placed above first section 61 of the waterproofing layer 6 and is subsequently covered by a second section 62 of the waterproofing layer 6, so as to hydraulically separate the collection volume 123 of the compensation tank 12 from the containment basin 3.

Otherwise, the collection channel 13 is preferably made at the same time as the surface finish step, and in particular it is made of the same drainage material that constitutes the surface finish layer 7.

The modular pool 1, as described above, therefore achieves the pre-established objects.

The contents of the Italian patent application number 102020000022462, from which this application claims priority, are incorporated herein by reference.

The invention claimed is:

1. A modular pool, comprising:

a support structure provided around a containment basin for water, said containment basin being delimited by a bottom and by a perimeter surface, said support structure comprising a plurality of metal plates with substantially constant thickness, joined together, each said metal plate comprising:

a base for resting on the ground, directed towards the interior of said modular pool;

an upright at least partially above ground;

at least one lateral edge provided with a reinforcement flange;

a waterproofing layer fixed to said support structure to coat the bottom and the perimeter surface of said containment basin;

a surface finish layer placed to cover said waterproofing layer;

wherein each said metal plate comprises two said lateral edges that are opposite each other and substantially L-shaped;

wherein each said lateral edge is provided with a first section extended along said base and with a second section extended along said upright;

wherein each metal plate comprises, for each said lateral edge, two reinforcement flanges including a first reinforcement flange placed along said first section and a second reinforcement flange placed along said second section.

2. The modular pool of claim 1, wherein said metal plates are made in a single body, with said base and said upright connected to each other by means of a bend of said metal plate.

3. The modular pool of claim 1, wherein said metal plates are placed in succession, side-by-side each other with the reinforcement flanges of two adjacent said metal plates fixed to each other.

4. The modular pool of claim 1, wherein said reinforcement flanges are directed towards the interior of said modular pool.

5. The modular pool of claim 1, wherein said reinforcement flanges are directed towards the interior of said modular pool;

wherein said first reinforcement flange is rigidly fixed to said second reinforcement flange.

6. The modular pool of claim 1, wherein said base has length greater than or equal to a third of the height of said upright.

7. The modular pool of claim 1, wherein the bases of said metal plates are provided with through holes;

wherein said modular pool comprises fixing elements fixed to the base of said metal plates and intended to be anchored to the ground;

wherein said fixing elements comprise a plurality of stakes, placed to traverse the through holes of said bases and driven into the ground.

8. The modular pool of claim 1, wherein said containment basin comprises:

a portion at least partially above ground, said portion being perimeter delimited by said perimeter surface and by an internal edge of said bottom which is extended at the bases of said metal plates;

a buried portion of said bottom, wherein said buried portion is extended into the ground starting from said internal edge, delimiting a buried volume.

9. The modular pool of claim 1, wherein said support structure comprises at least one flat element joined to said metal plates at at least one corner of said modular pool.

10. The modular pool of claim 1, further comprising at least one compensation tank side-by-side at two or more metal plates of said support structure, wherein said compensation tank is susceptible of collecting a water volume overflowed from said containment basin and is hydraulically connected to said containment basin in order to newly introduce the overflowed water volume to said containment basin;

wherein said waterproofing layer comprises:

a first section between said support structure and said at least one compensation tank;

a second section interposed between said at least one compensation tank and said containment basin for hydraulic separation between said at least one compensation tank and said containment basin;

wherein said compensation tank is hydraulically connected to said containment basin by means of a hydraulic duct.

11. The modular pool of claim 3, further comprising one or more tie rods placed as a connection between at least three consecutive metal plates.

12. The modular pool of claim 1, further comprising fixing elements fixed to the base of said metal plates.

13. A modular pool, comprising:

a support structure provided around a containment basin for water, said containment basin being delimited by a bottom and by a perimeter surface, said support structure comprising a plurality of metal plates with substantially constant thickness, joined together, each said metal plate comprising:

a base for resting on the ground, directed towards the interior of said modular pool;

an upright at least partially above ground;

at least one lateral edge provided with a reinforcement flange;

a waterproofing layer fixed to said support structure to coat the bottom and the perimeter surface of said containment basin;

a surface finish layer placed to cover said waterproofing layer;

wherein said containment basin comprises:

a portion at least partially above ground, said portion being perimeter delimited by said perimeter surface and by an internal edge of said bottom which is extended at the bases of said metal plates;

a buried portion of said bottom, wherein said buried portion is extended into the ground starting from said internal edge, delimiting a buried volume.

14. A modular pool, comprising:

a support structure provided around a containment basin for water, said containment basin being delimited by a bottom and by a perimeter surface, said support structure comprising a plurality of metal plates with substantially constant thickness, joined together, each said metal plate comprising:

a base for resting on the ground, directed towards the interior of said modular pool;

an upright at least partially above ground;

at least one lateral edge provided with a reinforcement flange;

a waterproofing layer fixed to said support structure to coat the bottom and the perimeter surface of said containment basin;

a surface finish layer placed to cover said waterproofing layer;

at least one compensation tank side-by-side at two or more metal plates of said support structure, wherein said compensation tank is susceptible of collecting a water volume overflowed from said containment basin and is hydraulically connected to said containment basin in order to newly introduce the overflowed water volume to said containment basin;

wherein said waterproofing layer comprises:

a first section interposed between said support structure and said at least one compensation tank;

a second section interposed between said at least one compensation tank and said containment basin for hydraulic separation between said at least one compensation tank and said containment basin;

wherein said compensation tank is hydraulically connected to said containment basin by means of a hydraulic duct.

* * * * *